United States Patent [19]

Mima

[11] Patent Number: 4,565,059

[45] Date of Patent: Jan. 21, 1986

[54] SPLICING DEVICE FOR SPUN YARNS

[75] Inventor: Hiroshi Mima, Joyo, Japan

[73] Assignee: Murata Kikai Kabushiki Kaisha, Japan

[21] Appl. No.: 611,102

[22] Filed: May 16, 1984

[30] Foreign Application Priority Data

May 17, 1983 [JP] Japan ..... 58-86049

[51] Int. Cl.[4] ..... D01H 15/00

[52] U.S. Cl. ..... 57/22

[58] Field of Search ..... 57/22, 261, 263

[56] References Cited

U.S. PATENT DOCUMENTS 4,292,796 10/1981 Mima ..... 57/22

4,452,035 6/1984 Rohner et al. ..... 57/22

4,507,912 4/1985 Noguchi ..... 57/22

FOREIGN PATENT DOCUMENTS 47-34652 8/1972 Japan ..... 57/22

*Primary Examiner*—Donald Watkins

*Attorney, Agent, or Firm*—Spensley, Horn, Jubas & Lubitz

[57] ABSTRACT

A yarn splicing device for spun yarns, wherein extremities of ends of the yarns which are inserted in overlapping and oppositely directed relationship in a yarn splicing hole are acted upon by flows of a fluid turning to be spliced with each other. The yarn splicing hole is substantially divided in an axial direction thereof into two yarn splicing holes which have center axes displaced from each other.

9 Claims, 26 Drawing Figures

SPLICING DEVICE FOR SPUN YARNS

BACKGROUND OF THE INVENTION

1. Field of the Invention

This invention relates to a device for splicing spun yarns wherein ends of two yarns inserted in a yarn splicing chamber are acted upon by a whirling fluid to splice the two yarns each other. Prior Art A device is conventionally employed wherein end portions of yarns overlapped one on the other are acted upon by a compressed fluid in order to splice such yarn ends to each other.

In an apparatus which employs such yarn splicing technique, such as an apparatus disclosed in a U.S. Pat. No. 4,002,012, two yarn ends are inserted into a yarn splicing hole so as to direct in opposite directions to each other and compressed air is injected into the yarn splicing hole to oscillate or turn the overlapping portions of the yarn ends, thereby causing to interlace yarn end portions with each other to effect splicing of the yarns. In this apparatus, if overlapping portions of the yarn ends are both clamped at two respective different positions thereof and segments of a particular dimension of the overlapping portions of the two yarns which are thus arrested within a particular section are turned, then fibers of the yarn end segments between the clamped points thereof will be enveloped to one another by temporary twisting, thus attaining intended splicing of the yarns. In such yarn splicing, however, extremities of the yarns outside the clamped portions extend from the opposite ends of the clamped portions and will remain as antennae to the yarns thus spliced. Such antennae may possibly be caught by a knitting needle in a subsequent knitting step to cause breakage of the yarn, thereby deteriorating the quality of a product such as a fabric and textiles.

Also, according to the apparatus as described above, yarns around a spliced joint may partially be coiled around each other in an opposite direction to the direction of twist peculiar to the yarns and thus run in parallel relationship. As a result, the spliced joint of the yarns will not present sufficient strength nor sufficient thickness. In particular, if substantially the center between the overlapping portions of the ends of both yarns is acted upon by an injected whirling air flow in a direction, then the overlapping portions are ballooned and the yarn ends on opposite sides of the acting point of the compressed air are twisted in opposite directions to each other so that one of the yarn ends is provided with a twist in the same direction to the twisting direction peculiar to the one yarn while the other yarn is provided with a twist in the opposite direction to the twisting direction peculiar to the other yarn. Accordingly, one portion of the spliced joint will be increased in strength while the other portion of the spliced joint will be reduced in strength, and since the maximum value of tensile strength of the spliced joint is determined by the weakest portion of the spliced joint, the entire spliced joint will have such a reduced strength.

SUMMARY OF THE INVENTION

An object of the present invention is to provide a yarn splicing device which assures a spliced joint which has substantially the same strength and thickness as those of individual single yarns to be spliced to each other.

In particular, the present invention provides a yarn splicing device wherein, spun yarns to be spliced to each other having a twist of one direction peculiar thereto, extremities of ends of the yarns which are inserted in overlapping and oppositely directed relationship in a yarn splicing hole are in free conditions and at least two different points of said yarn ends which are overlapped one on the other within said yarn splicing hole are individually acted upon by flows of a fluid turning in opposite directions such that they may be individually untwisted by the respective turning fluid flows, thereby assuring a spliced joint of yarns to be formed which has an actual twist having the same direction with the direction peculiar to the parent yarns. Thus, according to the present invention, a spliced joint of yarns can be obtained which has a structure very similar to the structure of the parent yarns and which has substantially the same strength, stretch and twisting number with a single yarn. In particular, the yarn splicing device according to the present invention is a yarn splicing device wherein a yarn splicing hole is substantially divided in an axial direction thereof into two yarn splicing holes which have center axes displaced from each other.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Now, embodiments of a yarn splicing device according to the present invention will be described with reference to the accompanying drawings.

It is to be noted here that the term "yarn" as used in the following description shall generally apply to a spun yarn consisting either of a bundle of staple fibers, that is, natural fibers such as cotton, wool, hemp and so on, and chemical long fibers which are cut short, or of a bundle of such mixed fibers. However, endless long chemical fibers may also be applied to the present invention if the conditions are partially modified suitably. Further, it is assumed that a "yarn" has a twisting number peculiar thereto which is represented by the number of twists per inch and that such twists are distributed substantially uniformly over the entire length of the yarn.

Figure 1:
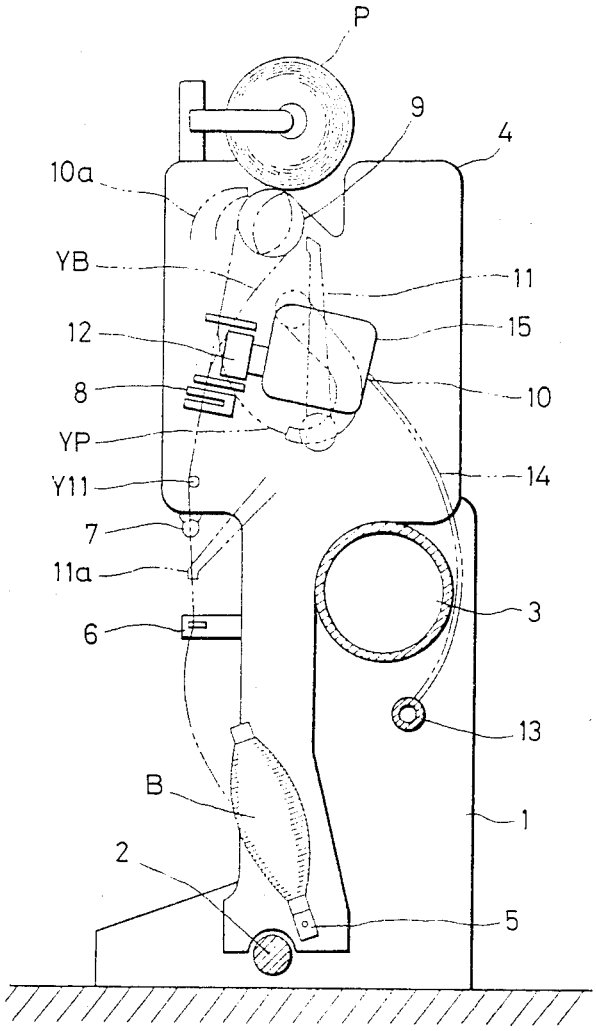
FIG. 1 is a side elevational view showing a general construction of a winder having a yarn splicing device.

FIG. 1 shows a schematic representation of an automatic winder to which a yarn splicing device is applied. The automatic winder includes a shaft 2 and a suction pipe 3 which extend between opposite side frames 1. A winding unit 4 is mounted for pivotal motion on the shaft 2, and during operation of the automatic winder, it is received by and suitably secured also to the pipe 3. The pipe 3 is connected to a blower not shown and is always acted upon by suction air flows.

On the winding unit 4, a yarn is rewound from a bobbin B onto a package P, and during such a rewinding operation, the yarn Y11 is drawn out from the bobbin B on a peg 5, passing a guide 6, a tenser 7 and a detecting device 8 which has dual functions for detecting and cutting an irregularity of a yarn such as a slub or the like and for detecting running of a yarn, and is taken up onto the package P which is rotated by a winding drum 9.

During the rewinding operation, if an irregularity of the yarn is detected by the detecting device 8, a cutter which is disposed in the neighborhood of the detecting device is rendered operative and cuts the thus running yarn Y11 to stop the rewinding operation and to thereafter effect a yarn splicing operation. In particular, a suction mouth 10 is rendered operative to introduce a yarn YP on the package to a yarn splicing device 12 which is disposed at a position spaced from a normal running path while a relay pipe 11 is rendered operative to introduce another yarn YB on the bobbin also to the yarn splicing device 12. At this yarn splicing device 12, both yarns YP and YB are spliced to each other and then a rewinding operation is resumed. The suction pipes 10 and the relay pipes 11 are both connected to the pipe 3 which is acted upon by suction air flows. A conduit 14 is connected between a pipe 13 of a different system and a yarn splicing unit 15 in order that fluid such as compressed air or the like may be used for the yarn splicing device 12.

Figure 2:
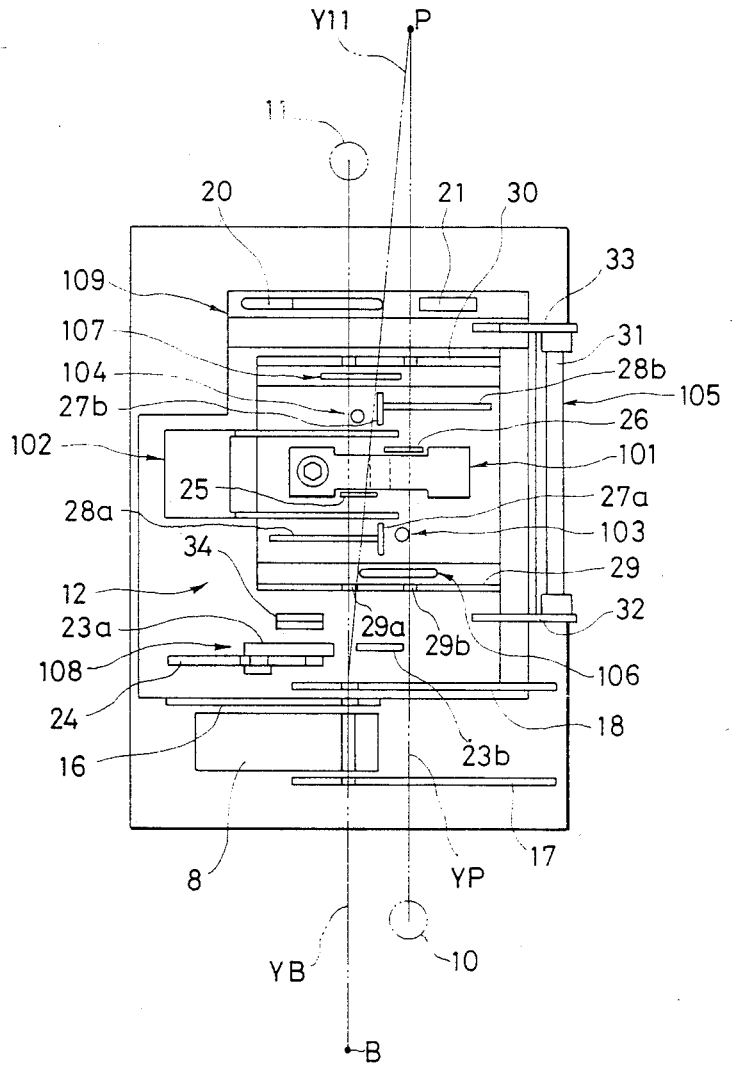
FIG. 2 is a front elevational view showing a general construction of an example of a yarn splicing device.
Figure 3:
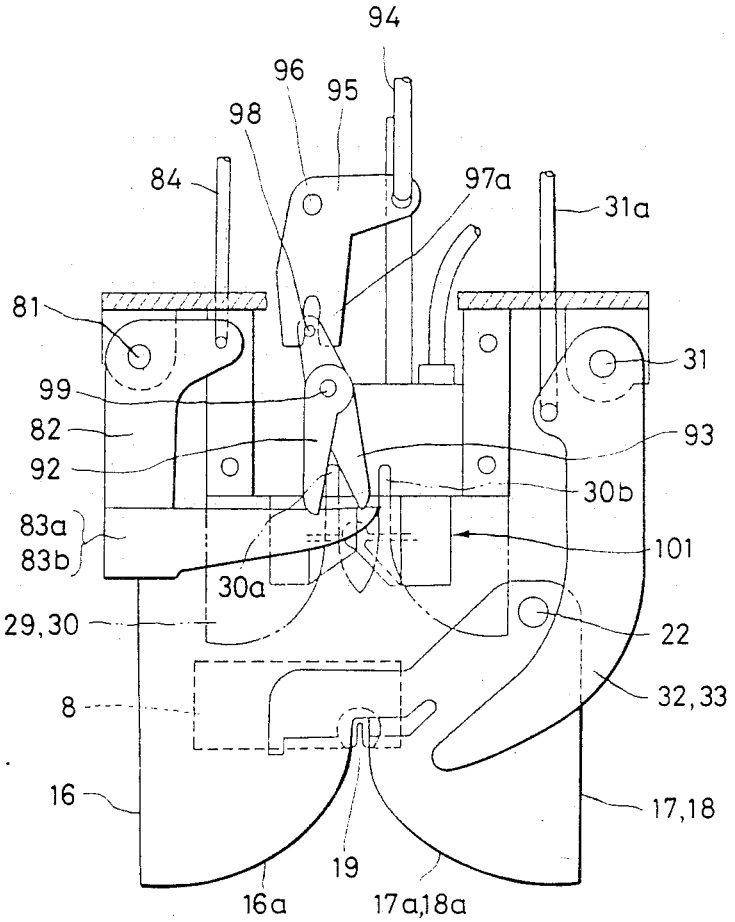
FIG. 3 is a plan view of the yarn splicing device of FIG. 2.

General construction of the yarn splicing device 12 is illustrated in FIGS. 2 and 3. During a normal rewinding operation, a yarn Y11 takes a route extending from a bobbin B to a package P passing the detecting device 8, a fixed guide 16 disposed adjacent one side of the detecting device 8 and pivotal guides 17 and 18 disposed adjacent opposite sides of the detecting device 8 and passing over the yarn splicing device 12.

The yarn splicing device 12 basically includes a yarn splicing member 101, a yarn pressing device 102, untwisting nozzles 103 and 104, a yarn handling lever 105, yarn cutting devices 106 and 107 and yarn clamping devices 108 and 109. The suction arms 10 and the relay pipes 11 are pivotally moved such that suction openings provided at ends thereof intersect each other above the yarn splicing device 12, and after an end section YP of a yarn on the package and an end section YB of another yarn on the bobbin are sucked into the suction openings, they are moved to and stop at respective positions outside the yarn splicing device.

Figure 4:
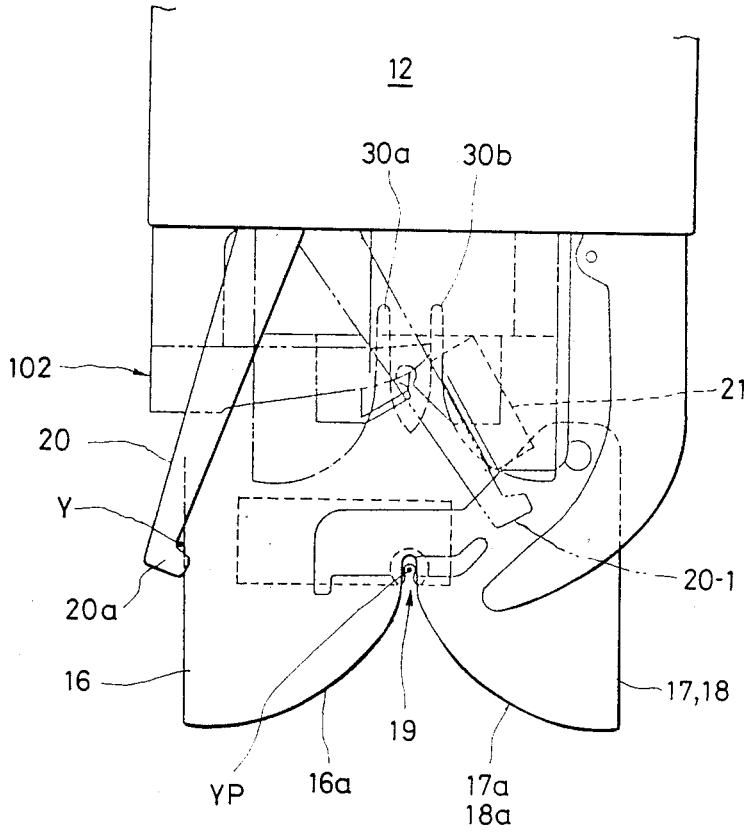
FIG. 4 is a plan view illustrating operations of a clamping device.

It is to be noted that operations of the suction arm 10 and the relay pipes 11 occur not at the same time but with some time lag one after the other. In particular, at first the yarn end section YP on the package is pivotally moved to and stops at a position outside the yarn splicing device by the suction mouth 10, and substantially at the same time, a pivotal lever 20 of the clamping device 109 on the package P side is pivoted by means of a control cam not shown in a counterclockwise direction to a phantom position 20-1, as shown in FIG. 4, in which it is abutted against and stopped by a support block 21 secured to a fixed position. At this instant, the yarn YP is engaged and moved by a hooked portion 20*a* of the pivotal lever 20 until it is clamped between the support block 21 and the pivotal lever 20.

Figure 5:
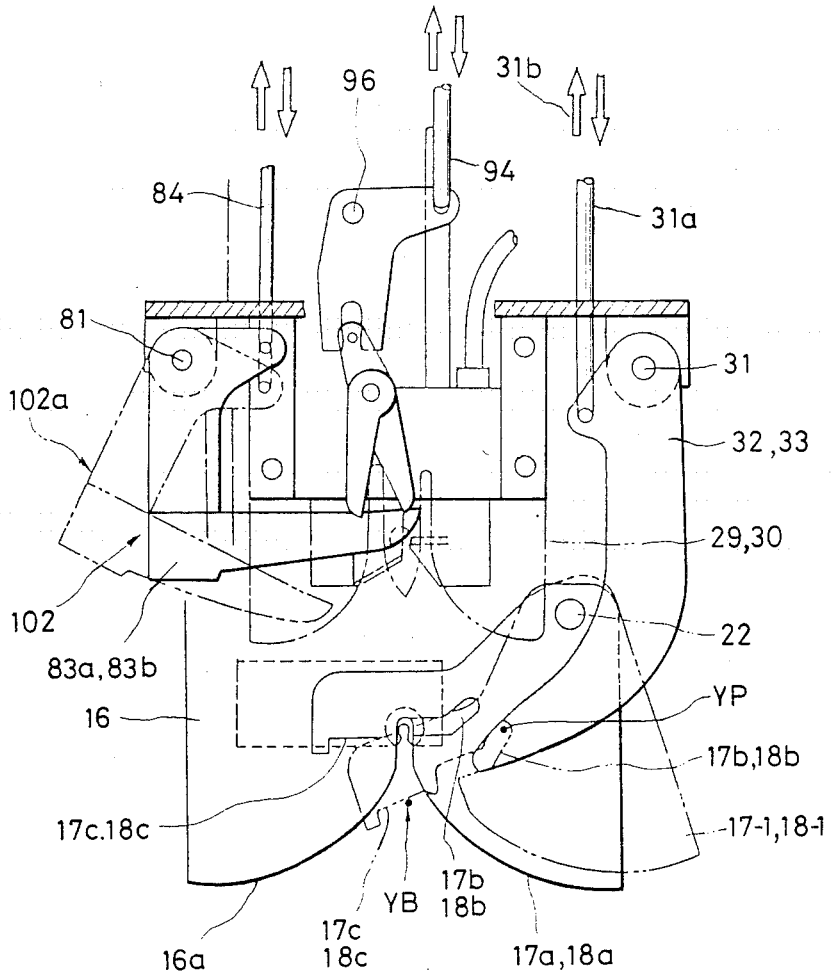
FIG. 5 is a plan view showing a construction of a yarn pressing device, a yarn cutting device and a pivotal guide plate.

In the meantime, while the pivotal lever 20 is moving, portions of the yarn YP positioned on the fixed guide 16 and the pivotal guides 17 and 18 are guided along inclined faces 16*a*, 17*a* and 18*a* of the guides 16, 17 and 18 and enter a guide groove 19. Then, it is confirmed by the detecting device 8 disposed in the same station with the guide groove 19 if the yarn YP is present or not, if there are two yarns sucked by the suction mouth in error, and so on, and after the yarn YP is confirmed, the pivotal guides 17 and 18 are pivoted in a counterclockwise direction around a support shaft 22, as shown in FIG. 5, by means of control cams not shown so that the yarn YP is removed from the detecting device 8 and is then fitted into relief grooves 17*b* and 18*b* of the pivotal guides 17 and 18.

Then, substantially at the same time with the pivotal motions of the pivotal guides 17, 18, the yarn end section YB on the bobbin B side is sucked by the relay pipe 11 and is pivoted in a direction opposite to the pivoting direction of the suction mouth 10 until it is moved to and stopped at a position outside the yarn splicing device. Substantially at the same time with stopping of the pivotal motion of the relay pipe 11, a support plate 23*a* of the clamping device 108 is moved in the same direction with the pivotal lever 20 along a guide plate 24 by means of a control cam not shown, and during this movement, it is engaged with the yarn YB. This movement of the support plate 23*a* is stopped when it is abutted against a support block 23*b* secured at a fixed position and the yarn YB is thus clamped between the support plate 23*a* and the support block 23*b*. In this instance, the yarn YB is engaged by hooked portions 17*c* and 18*c* provided adjacent ends of the pivotal guides 17 and 18, respectively, as seen in FIG. 5, and checking by the detecting device 8 is effected after completion of a yarn splicing operation.

Located substantially at the center of the yarn splicing device 12 is the yarn splicing member 101, and adjacent opposite sides of the yarn splicing member 101, yarn end controlling plates 25 and 26, the yarn pressing device 102, the untwisting nozzles 103 and 104, guide plates 27*a* and 27*b* and guide rods 28*a* and 28*b*, the yarn cutting devices 106 and 107, and fork guides 29 and 30 are disposed in order. Adjacent one side of the yarn splicing device 101, the yarn handling lever 105 is disposed which includes a support shaft 31 and a pair of levers 32 and 33 mounted for pivotal motion on the support shaft 31. The yarn handling lever 105 guides the yarn end sections YP and YB toward the yarn splicing device 12 after the detecting device 8 has detected and the cutting device not shown has cut off a slub or a thinner portion of the yarn Y11 and the suction arm 10 and the relay pipe 11 have been rendered operative to guide the respective yarn end sections YP and YB to respective positions outside the yarn splicing device 12. It is to be noted that the yarn handling lever 105 is pivoted within an extent which is defined by a stop 34 disposed for engagement therewith between the fork guide 29 and the yarn clamping device 108.

Figure 6:
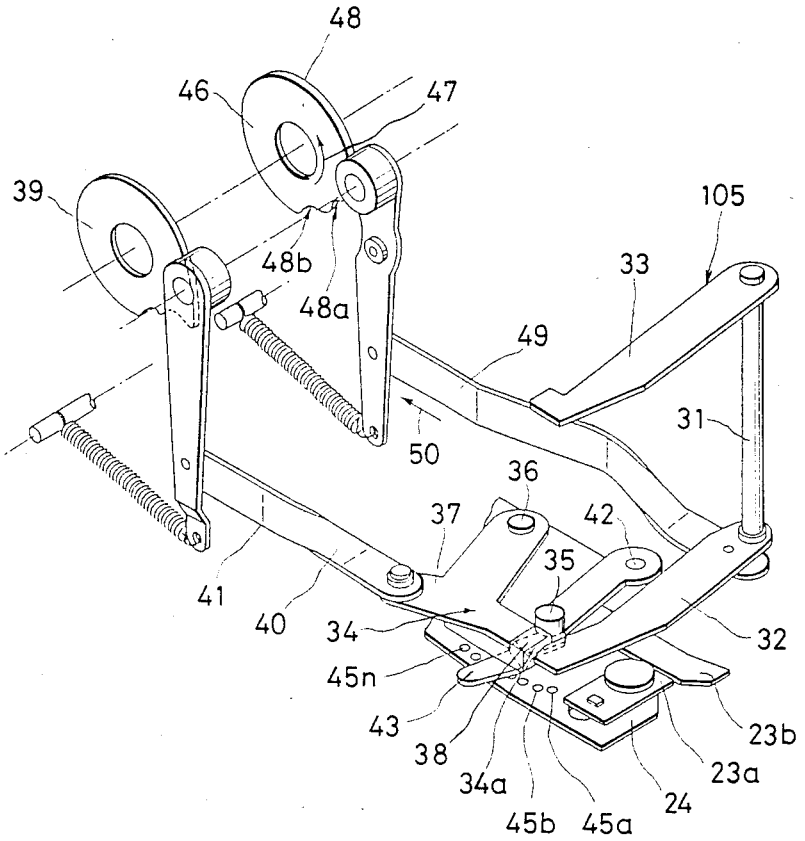
FIG. 6 is a perspective view showing a stop for a yarn handling lever.
Figure 7:
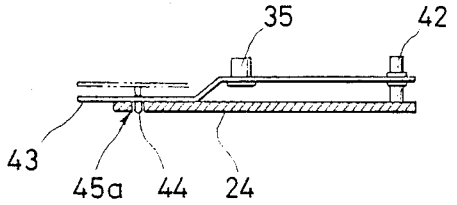
FIG. 7 is a diagrammatic representation illustrating an operation of an adjusting stop.

The stop 34 is mounted for movement between two positions, and the position at which the yarn handling lever 105 is stopped by the stop 34 is a fixed position, the stop 34 being operative upon the yarn handling lever 105 when a yarn cutting operation is performed by the yarn cutting device. Another stop 35 for adjustment of the length of overlapping portions of yarn ends is provided as seen in FIG. 6. In particular, referring to FIG. 6, the first stop 34 includes a block 38 secured at an end of a lever 37 which is mounted for pivotal motion between two positions around a fixed pivot 36. The stop 34 is operated by a rod 40 operatively associated with a control cam 39 so that it can be moved and fixed to an operative position as shown in FIG. 6 and another inoperative position pivotally spaced in the direction of an arrow mark 41 from the operative position. In particular, when a yarn cutting operation is to be performed by the yarn cutting devices 106, 107, the arm 32 of the yarn handling lever 105 is in a position abutted against the first stop 34 to keep constant the length or distance from a clamped point to the extremity of the yarn end. Meanwhile, the second stop 35 is secured to an adjusting lever 43 which is mounted for pivotal motion around a fixed pivot 42. As shown in FIG. 7, a pin 44 is fixedly mounted on the bottom face of the lever 43 and is disposed for selective engagement with positioning holes 45*a* to 45*n* perforated along an arcuate line in the guide plate 24 in order to selectively determine the position of the second stop 35.

If a cam 46 is rotated in the direction of an arrow mark 47, a rod 49 is allowed to be pulled in the direction of another arrow mark 50 due to a cam face 48*a* of the cam 48, and hence the lever 32 is pivoted to the position abutted against the first stop 34*a*. Thereupon, a yarn cutting operation is performed. Then, the lever 32 is once pivoted back in the opposite direction whereupon yarn ends thus cut are sucked into an untwisting nozzle, which will be described hereinafter. Subsequently, the lever 32 is again allowed to be pivoted due to another cam face 48*b* of the cam 48 to the position defined by the second stop 35. In this case, the first stop 34 has already been pivotally moved to the inoperative position thereof, that is, a position behind the second stop 35, by operation of the cam 39. In particular, by pivotal motion of the lever 32 until it is abutted against the second stop 35, the amount or extent of yarn ends to be drawn out from an untwisting nozzle, that is, an extent over which yarn ends are overlapped one on the other on the yarn splicing apparatus, is determined. As the amount of pivotal motion of the yarn handling lever is set greater, the amount of yarn ends to be drawn out increases thereby to reduce the extent or distance over which the yarn ends are overlapped one on the other.

Figure 8:
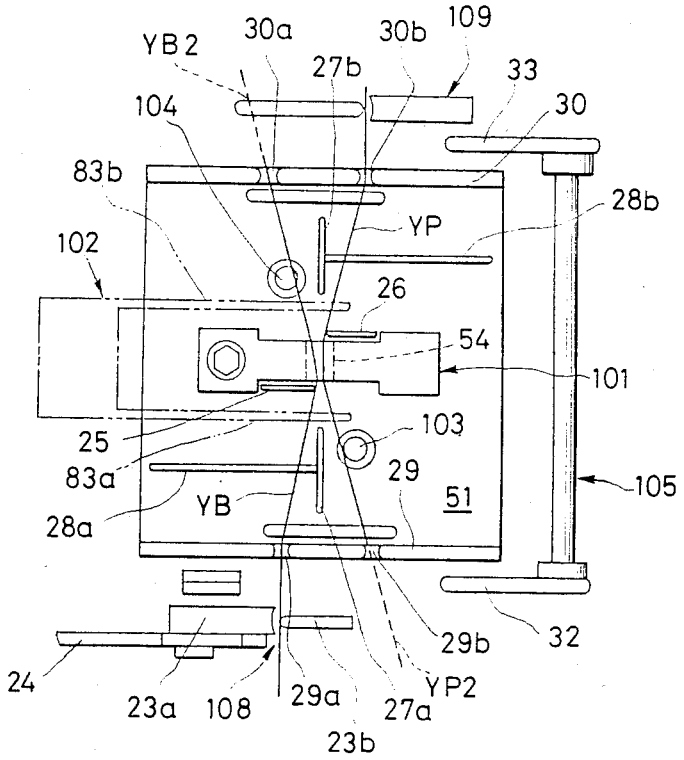
FIG. 8 is a front elevational view showing ends of yarns YP and YB inserted in the yarn splicing device.
Figure 9:
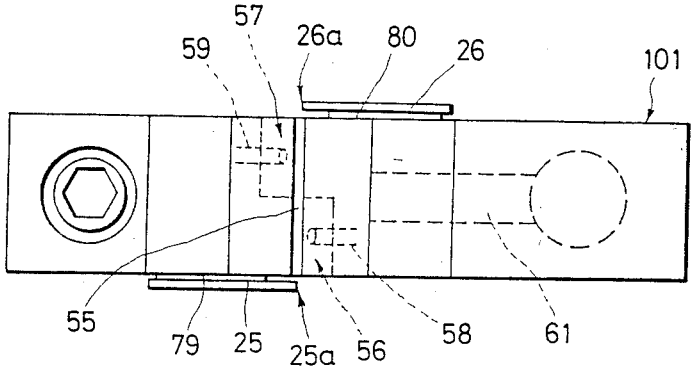
FIG. 9 is a front elevational view showing relative positions of a yarn splicing member and control plate.
Figure 10:
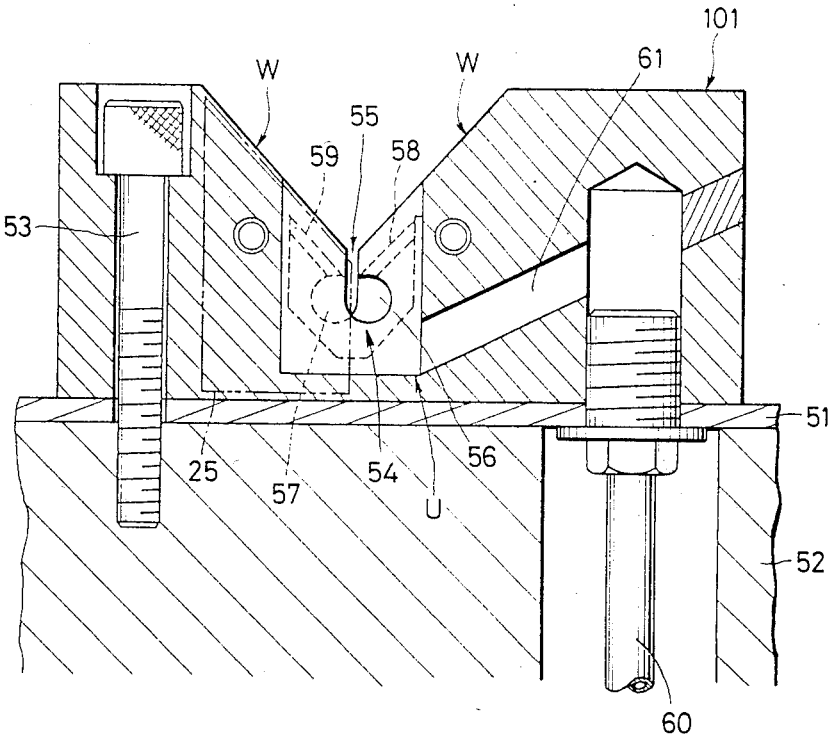
FIG. 10 is a plan view, partly in section, showing an embodiment of the yarn splicing member.

The yarn splicing member 101 is shown in FIGS. 8 to 10. The yarn splicing member 101 is screwed 53 onto a bracket 52 via a front plate 51 and has a yarn splicing chamber 54 formed substantially in the center thereof while it has a slit 55 formed at a joining part of inclined wall faces W thereof and extending along the full length of an axis of the yarn splicing chamber thereof in such a manner as to facilitate insertion of yarns YP, YB into the yarn splicing chamber 54 from outside.

The yarn splicing chamber 54 is divided substantially into two sections by an imaginary plane perpendicular to the axis thereof, and the thus divided first and second yarn splicing holes 56 and 57 have their axes displaced from each other. In the present embodiment, the first and second yarn splicing holes 56, 57 are located symmetrically relative to a center of the slit 55 of the yarn splicing member 101. Each of the yarn splicing holes 56, 57 has a fluid injection nozzle hole 58 or 59 perforated to open in tangential relationship to an inner circumferential face thereof. Supply of fluid to the nozzle holes 58, 59 is effected from a compressed air supply pipe 60 by way of a path 61 formed in the yarn splicing member 101.

It is to be noted that the yarn splicing member 101 shown in FIG. 10 has a yarn splicing nozzle unit U removably fitted therein which has yarn splicing holes formed therein, and the yarn splicing nozzle unit U can be replaced by a selected one of yarn splicing nozzle units prepared in prior which have various configurations in accordance with types and counts of yarns to be spliced.

Embodiments of the yarn splicing nozzle unit U will be described below.

Figure 11:
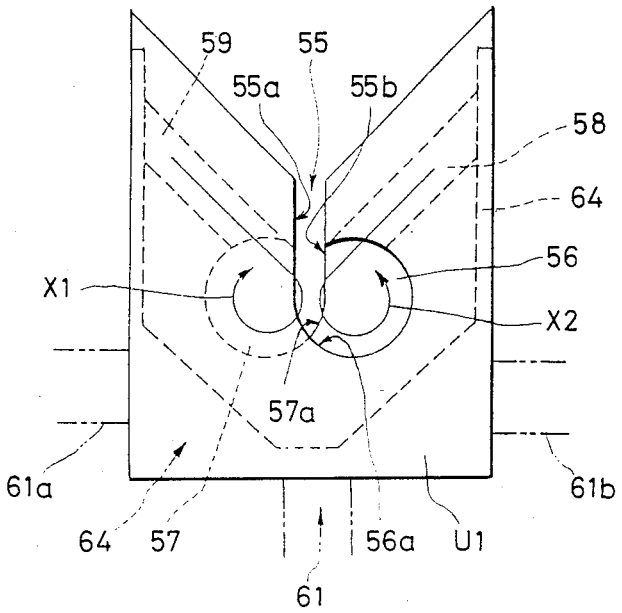
FIGS. 11 and 12 illustrate a first embodiment of a yarn splicing nozzle unit according to the present invention, FIG. 11 being a plan view, and FIG. 12 a front elevational view.
Figure 12:
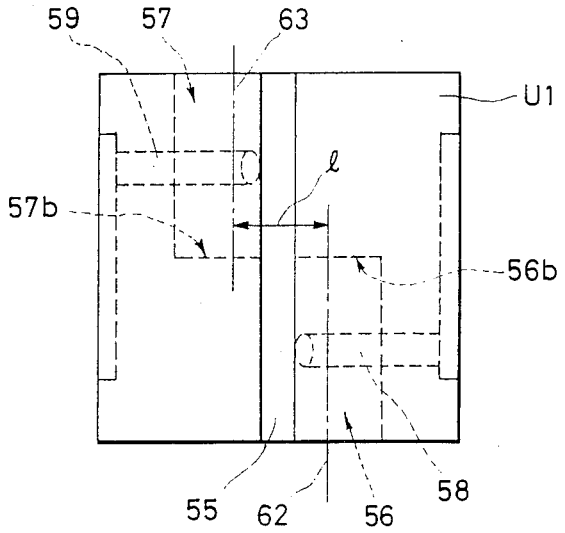

FIGS. 11 and 12 illustrate a first embodiment of the yarn splicing nozzle unit which is shown in FIG. 10. The yarn splicing nozzle unit U1 shown has first and second yarn splicing holes 56 and 57 formed therein which each present a substantially circular cross section in a plane perpendicular to an axis 62 or 63 thereof with the axes 62, 63 being spaced a distance (l) from each other. The yarn splicing nozzle unit U1 has a yarn inserting slit 55 formed therein in common relationship to both yarn splicing holes 56, 57. A side wall 55*a* of the slit 55 is tangentially continuous to an inner circumferential face 56*a* of the first yarn splicing hole 56 while another side wall 55*b* of the slit 55 is tangentially continuous to an inner circumferential face 57*a* of the second yarn splicing hole 57. Fluid injecting holes 58, 59 are tangentially opened to the inner circumferential faces of the yarn splicing holes 56, 57, respectively, and are perforated adjacent portions at which the slit 55 and the inner circumferential faces 56*a*, 57*a* cross each other so that fluid injected from the nozzle holes 58, 59 may form whirling flows in opposite directions X1 and X2 to each other as shown in FIG. 11. In the present embodiment, the peculiar twist of the yarns to be spliced is the Z twist, and the whirling directions X1, X2 of the whirling flows coincide with directions to untwist the twist (Z twist) of the original yarns.

The yarn splicing nozzle unit U1 has a fluid supply path 64 formed therein which is connected to a supply path 61 of the yarn splicing member. It is to be noted that a position at which the supply path 61 and the path 64 are connected to each other is, in the present embodiment, preferably the central position 61 of the unit, but, from productive or structural restrictions, they may otherwise be connected to each other at a left or right side position 61*a* or 61*b* of the unit. The connection at the central position 61 is desirable in that fluid supplied from the supply path 61 to the path 64 is injected from the injecting nozzle holes 58, 59 into the yarn splicing holes 56, 57 in the same periods of time.

Figure 13:
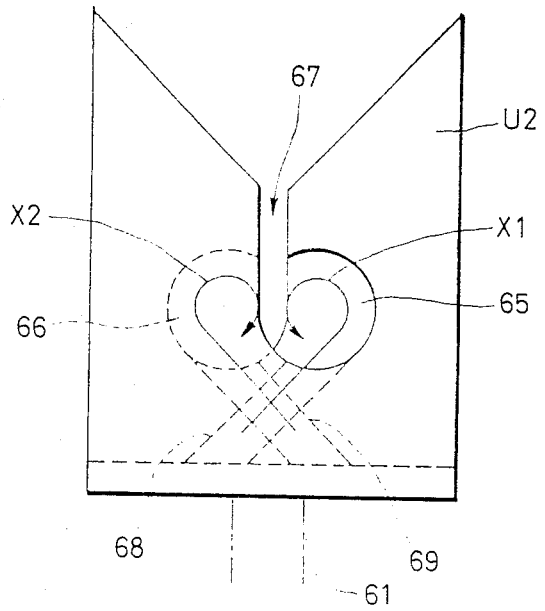
FIGS. 13 and 14 are views illustrating a second embodiment of the yarn splicing nozzle unit.
Figure 14:
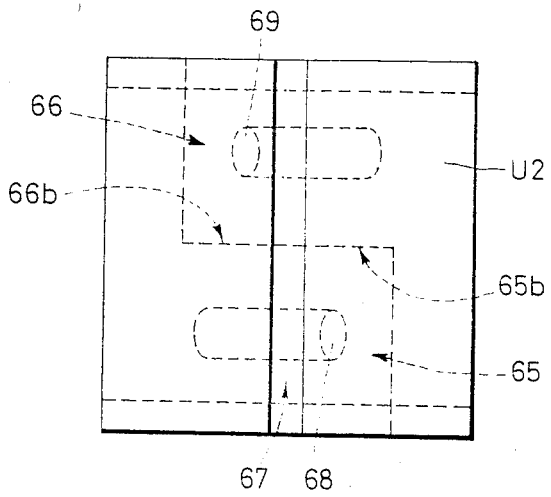

A second embodiment of the yarn splicing nozzle unit is illustrated in FIGS. 13 and 14. In particular, a single yarn splicing nozzle unit U2 has substantially divided two yarn splicing holes 65 and 66 formed therein which have their axes displaced from each other, as in the first embodiment. Inner circumferential faces of the yarn splicing holes 65, 66 are partially tangentially continuous to a common slit 67, and fluid injecting nozzles 68 and 69 which are tangentially opened to the yarn splicing holes 65, 66, respectively, are formed at portions of the unit opposite to the slit 67, that is, opposite to the yarn introducing side. Thus, the fluid injecting nozzles 68, 69 are formed to inject fluid therefrom so that whirling flows of the fluid may be directed to untwist the twist (Z twist) of the parent yarns.

Figure 15:
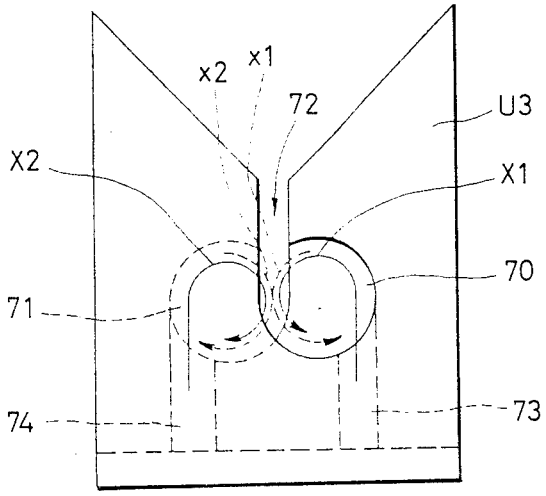
FIGS. 15 and 16 are views illustrating a third embodiment of the yarn splicing nozzle unit.
Figure 16:
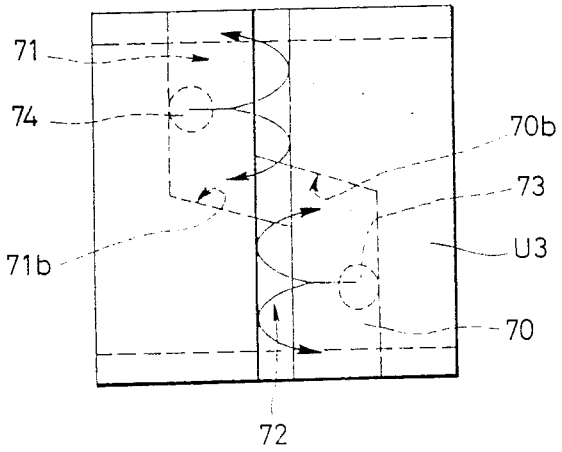

FIGS. 15 and 16 illustrate a third embodiment of the yarn splicing nozzle unit. In the embodiment, relative positions of yarn splicing holes 70 and 71, a slit 72 and so on, which are formed in the nozzle unit U3, are similar to those of the first and second embodiments while fluid injecting nozzle holes 73 and 74 which are opened to inner circumferential faces of the yarn splicing holes 70 and 71 are formed at portions of the unit U3 opposite to the slit 72. In this embodiment, the nozzle holes 73, 74 extend in parallel relationship to each other, distinct from the above described embodiments in which the nozzle holes extend in directions to cross each other. Whirling directions X1 and X2 of fluid injected are opposite to each other so that the Z twist of the parent yarns may be untwisted, as in the foregoing embodiments.

Figure 17:
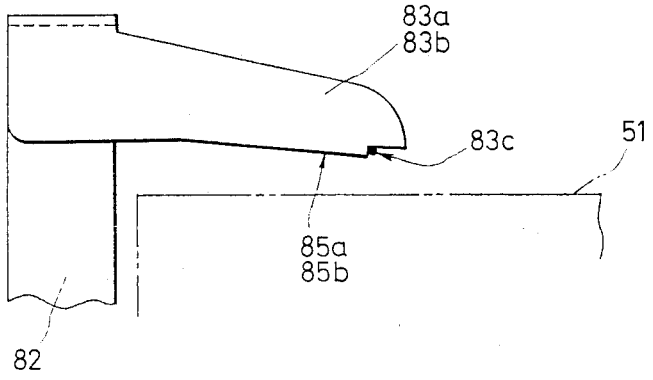
FIG. 17 is a plan view showing the configuration of a yarn pressing lever.

It is to be noted that bottom faces 70*b* and 71*b* of the yarn splicing holes 70 and 71, respectively, are inclined, in this embodiment, toward their respective counterparts. In particular, air flows injected from the nozzle holes 73, 74 are split in upward and downward directions as shown in FIG. 16 to form whirling air flows X1 and X2 as shown in FIG. 17. Thus, air flows directly after they are injected are strong whirling flows but they tend to become weak as they approach end faces of the openings and the bottom faces of the yarn splicing holes. In this connection, particularly in the neighborhood of the bottom faces 70*b*, 71*b* in which a mid portion of a spliced joint is disposed, whirling air flows in the yarn splicing holes 70, 71 are supplementarily added to those in the respective counterparts in the same whirling directions. In particular, in FIG. 15, arrow marks X1 and X2 in broken lines show air flows in the neighborhood of the bottom faces 70*b* and 71*b*, and the whirling air flow X1 in the yarn splicing hole 70 flows along the inclined face 70*b* into the other yarn splicing hole 71 and thus becomes a whirling air flow in the X2 direction which joins the whirling air flow in the yarn splicing hole 71. Similarly, the whirling air flow X2 in the yarn splicing hole 71 flows into the yarn splicing hole 70 and becomes a whirling air flow in the X1 direction which joins the whirling air flow in the yarn splicing hole 70.

It is also to be noted that bottom faces 56*b*, 57*b* or 65*b*, 66*b* of the yarn splicing holes 56, 57 or 65, 66 in the first or second embodiment, respectively, are contained in a same plane so as to prevent interference of whirling air flows in the individual yarn splicing holes with each other.

It is further to be noted that the yarn splicing nozzle units U1, U2 and U3 of the first, second and third embodiments are nozzle units applied for parent yarns which have a peculiar twist thereto in the Z direction, and otherwise for use with yarns having the S twist, yarn splicing nozzle units can be obtained either by changing the positions at which the fluid injecting nozzles are opened to the inner circumferential faces of the yarn splicing holes or by changing the positions of the yarn splicing holes 56, 57 themselves.

Referring again to FIGS. 8 to 10, control plates 25, 26 are screwed adjacent opposite sides of the yarn splicing member 101 with spacers 79, 80 interposed therebetween, respectively. The control plates 25, 26 are each positioned such that a particular side edge 25*a* or 26*a* thereof crosses part of the opening of the yarn splicing hole 56 or 57. Of the control plates 25 and 26, the upper one 26 is provided for controlling a yarn YP extending to a package while the lower control plate 25 is provided for controlling a yarn YB extending from a bobbin. Accordingly, the control plate 26 is disposed on the side facing the nozzle hole 59 while the other control plate 25 is disposed on the opposite side facing the other nozzle hole 58.

In particular, the control plates 25, 26 cooperate with the yarn pressing lever 102, which will be described hereinafter, to position two yarns inserted in the yarn splicing chamber 54 in a mutually contacted position so as to control flows of fluid in such a manner as to assure first interlacing of both yarn ends with each other when fluid is injected, to prevent untwisting when both yarns are turned in a separate condition, to control the flow rate of fluid flowing out from openings at opposite ends of the yarn splicing holes 56 and 57, to prevent yarn ends from leaping out of the yarn splicing chamber 54, to control turning motion of the clamped original yarns, and to promote yarn end portions to be interlaced sufficiently with their counterparts. In particular, if the yarn ends YP, YB are acted upon by injected fluid, then a balloon is produced. Here, if the rotational frequency of such a balloon rises, then fibers near a balloon neck will come off by a yarn brandishing action of the balloon, resulting in increase of probability of yarn breaks. In consideration of these circumstances, the control plates 25, 26 are provided to control the rotational frequency of a balloon which is suitable for splicing of yarns.

Further, the yarn pressing device 102 which is disposed to extend along opposite sides of the yarn splicing member 101 as shown in FIGS. 3, 5 and 8 is provided to draw out, in association with pivotal motion of the yarn handling lever 105 which will be described hereinafter, the yarn ends YP, YB which have been untwisted by the yarn end untwisting nozzles 103, 104 from the yarn end untwisting nozzles 103, 104 and to place the yarn ends YP, YB in position within the yarn splicing chamber 54 of the yarn splicing member 101 as well as to control relative positions of the yarns YP, YB in cooperation with the control plates 25, 26. In addition, the yarn pressing device 102 has a function to curve, in cooperation with guide rods 28*a*, 28*b* which will be hereinafter described, yarns between clamped points thereof and the yarn splicing chamber to prevent propagation of untwisting actions.

The yarn pressing device 102 includes a pair of yarn pressing plates 83*a*, 83*b* secured to a lever 82 which is mounted for pivotal motion around a pivot 81 secured to a fixed position as shown in FIG. 3. Thus, if a rod 84 is operated by a control cam not shown, the yarn pressing plates 83*a*, 83*b* are pivoted as seen in FIG. 5. Further, as shown in FIG. 17, the yarn pressing plates 83*a*, 83*b* are each forked toward their ends and each have a shoulder 83*c* formed at an end portion thereof. The yarn pressing plate 83*a*, 83*b* thus have a same configuration. Yarn pressing side edges 85*a*, 85*b* of the yarn pressing plates 83*a*, 83*b* are, upon operation, in their upper positions above a front plate 51 to which the yarn splicing member is secured so that yarns cannot be clamped between the yarn pressing plates 83*a*, 83*b* and the front plate 51 and leftward and rightward swinging motions of the original yarn are inhibited by the shoulders 83*c* of the yarn pressing plates 83*a*, 83*b*.

Figure 18:
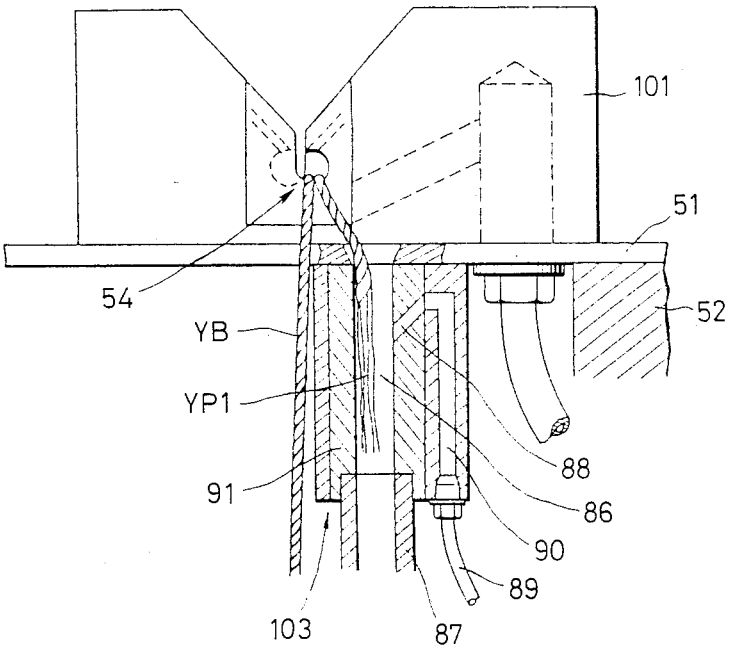
FIG. 18 is a sectional plan view showing an example of a yarn untwisting nozzle.

The yarn end untwisting nozzles 103 and 104 disposed adjacent opposite sides of the yarn pressing device 102 have a similar structure and hence only one such nozzle 103 will be described with reference to FIG. 18. In particular, a yarn end YP1 on the package side to be spliced is introduced into a nozzle hole 86 of a circular cross section formed in the bracket 52 by way of the yarn splicing chamber 54. Such introduction of the yarn end YP1 into the nozzle hole 86 is effected by a sucking action of the aforementioned suction pipe 3 connected therewith by means of a flexible pipe 87. After the yarn end YP1 has been introduced into the nozzle hole 86, fluid is injected from a fluid injection hole 88 opened obliquely to the nozzle hole 86 to untwist the yarn end YP1 and to bring fibers of the yarn end substantially into parallel conditions. It is to be noted that the fluid injection nozzle 88 is preferably perforated in tangential relationship to an inner circumferential face of the nozzle hole 86 so as to produce turning air flows in a direction opposite to the twisting direction of the yarn end. Supply of fluid to the fluid injection hole 88 is effected by way of a communicating hole 90 from a pipe 89 connected thereto by the aforementioned conduit 14.

It is to be noted that the length of a portion of a yarn end to be untwisted varies depending upon the position of the opening of the fluid injection hole 88 to the nozzle, or in other words, depending upon the distance of the opening from the opening face at the top of the nozzle. Accordingly, it is desirable that the position of the opening of the injection hole can be adjusted depending upon various conditions such as types of yarns made of fibers having greater or smaller average in length or else so as to assure most appropriate untwisted conditions of overlapping portions of yarn ends within the yarn splicing hole of the yarn splicing member. To this end, a sleeve 91 is fitted for back and forth movement.

Figure 19:
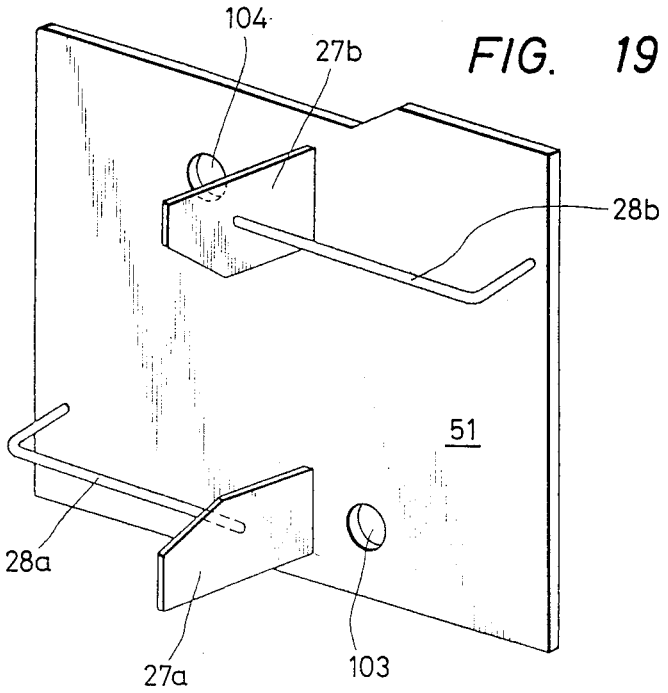
FIG. 19 is a perspective view illustrating a relationship between a guide plate and a guide rod.
Figure 20:
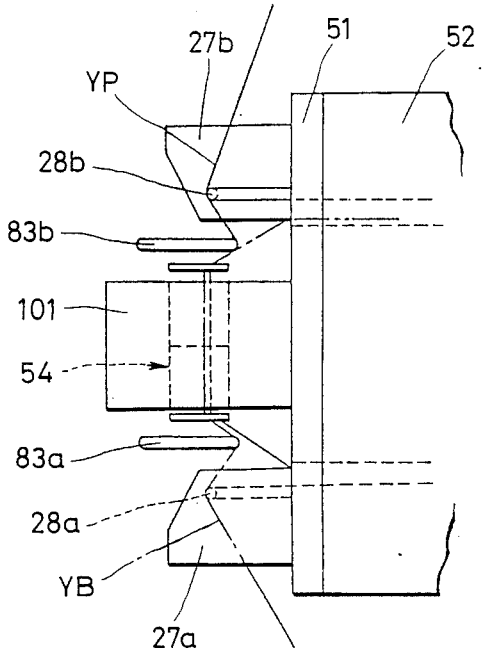
FIG. 20 is a side elevational view showing curved formations of a yarn by the arrangement of FIG. 19.

Subsequently, guide means secured to the front plate 51 will be described with reference to FIGS. 8, 19 and 20. The guide plate 27*a*, 27*b* are located on a center line of the yarn splicing chamber 54 and are secured upright to the front plate 51. The guide plates 27*a*, 27*b* are disposed, as seen in FIG. 11, such that a sucking force of the yarn end untwisting nozzles 103, 104 may not influence on portions of the yarns YP, YB which are not to be sucked. Further, the guide plates 27*a*, 27*b* each have a guide rod 28*a* or 28*b* fixedly mounted on one side face thereof in a spaced relationship from the top face of the front plate 51. The guide rods 28*a*, 28*b* extend to opposite side ends of the front plate 51 in parallel relationship with the top face of the front plate 51 and are bent thereat in L-shape and fixedly mounted at their ends on the front plate 51. Accordingly, the yarns YP, YB which are inserted into the yarn splicing chamber 54 by means of the yarn handling lever 105 take a path spaced from the front plate 51 while they are contacted with the guide rods 28*a* and 28*b*, as seen from FIG. 20. In particular, as described hereinbefore, the guide rods 28*a*, 28*b* cooperate, during a yarn splicing operation, with the yarn pressing lever 102 to provide curved formations to portions of yarns between the yarn splicing chamber 54 and the clamping devices 108, 109 thereby to prevent propagation of an untwisting action of the yarns by a turning fluid flow within the yarn splicing holes.

Referring again to FIGS. 2, 3 and 5, the yarn cutting devices 106, 107 are provided inside the guide plates 29, 30, respectively, and each include a fixed blade 92 and a movable blade 93. If a rod 94 is operated as seen in FIG. 3 by a control cam not shown, then a forked lever 95 is pivoted in a clockwise or counterclockwise direction about a pivot 96. Upon this pivotal motion of the forked lever 95, a fork portion 97 thereof moves a support pin 98 on the opposite end of the movable blade 93 thereby to pivot the movable blade 93 about a pivot 99.

Further, the fork guides 29, 30 secured outside the yarn cutting devices 106, 107 have guide grooves 29*a* and 29*b*, 30*a* and 30*b*, as shown in FIG. 8. In addition, the yarn handling lever 105 disposed adjacent a side of the yarn splicing member 101 is pivoted in a clockwise direction about the pivot 31, as shown in FIGS. 3 and 5, by a control cam not shown via a rod 31*a* to introduce the yarns YP, YB into the guide grooves 29*a* and 29*b*, 30*a* and 30*b* and then into the yarn splicing chamber 54 through the slit from the inclined face of the yarn splicing member.

Yarn splicing operations with the above-described yarn splicing device will be described now.

(a) Yarn Preparing, Clamping Step

Referring to FIG. 1, when the detecting device 8 detects that a yarn during rewinding is broken or a yarn layer on a bobbin has been used up, rotation of the drum 9 is stopped while a one revolution clutch not shown is rendered operative so that a yarn splicing operation may be effected either by means of several control cams mounted on a shaft which is connected to be rotated via the clutch or by means of several control cams operatively connected to the shaft.

At first, the suction mouth 10 and the relay pipe 11 are pivotally moved from the respective phantom positions 10*a* and 11*a* of FIG. 1 with yarn end sections sucked therein, respectively. During this movement, they pass over the yarn splicing device 12 in such a manner that a yarn YP on the package P side and another yarn YB on the bobbin B side cross each other, and they stop at respective positions outside the yarn splicing device.

In particular, at a time during a period after initiation of operation of the suction mouth 10 until the relay pipe 11 initiates its operation, the yarn clamping device 109 on the package side is rendered operative so that the yarn YP is clamped between the pivotal lever 20 and the support block 21 as shown in FIGS. 4 and 5 and then introduced into the guide groove 19 defined by the fixed guide 16 and the pivotal guides 17 and 18 all disposed in the neighborhood of the detecting device 8 in order to effect checking with the detecting device 8. Subsequently, the pivotal guides 17 and 18 are pivoted in the counterclockwise direction in FIG. 3 around the pivot shaft 22 to thus remove the yarn YP from the detecting device 8 and to fit the same into the relief grooves 17*b* and 18*b*.

Then, the relay pipe 11 sucks the yarn YB on the bobbin B side therein and is pivoted to and stops at a position outside the yarn splicing device 12. At this instant, the yarn YB passes the hooked portions 17*c* and 18*c* of the pivotal guides 17 and 18, respectively, and is clamped between the support plate 23*a* of the yarn clamping device 108 and the support block 23*b* as shown in FIG. 8.

(b) Yarn Putting Aside, Cutting Step

After completion of the yarn clamping steps, the arms 32 and 33 of the yarn handling lever 105 shown in FIGS. 2 and 8 are pivotally moved around the support shaft 31 to introduce the yarns YP and YB on both sides individually into the guide grooves 29*a*, 29*b* and 30*a*, 30*b* of the fork guides 29 and 30, respectively while they are inserted into the yarn splicing chamber 54 of the yarn splicing member 101 through the slit 55.

Figure 21:
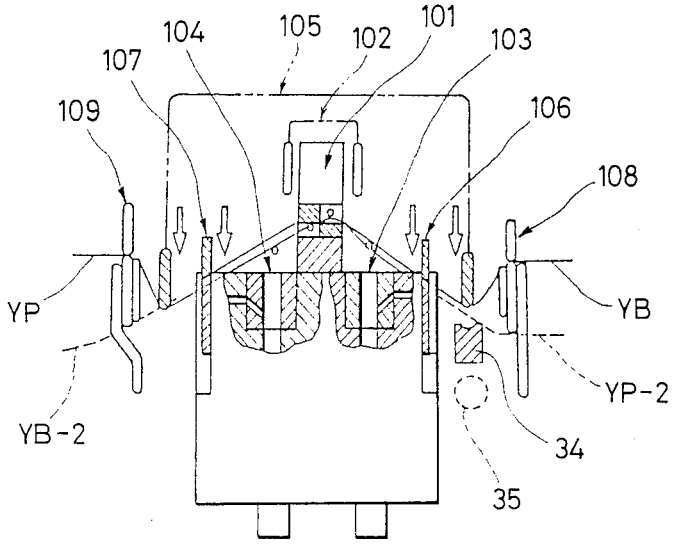
FIGS. 21 to 23 are diagrammatic representations showing yarn splicing operations by the yarn splicing device.

Then, the yarn cutting device 106 and 107 are rendered operative to effect cutting of yarns YP2 and YB2 as seen in FIG. 8 at positions spaced by a predetermined distance from the clamping devices 108 and 109, respectively. The positions at which yarns are cut relate to the length of a joint of the yarns to be spliced and have influence on an appearance of the joint of the yarns spliced and also on the strength of the joint. Thus, such positions are differentiated by the count of a yarn used. In particular, referring to FIG. 21, while the yarns YP and YB on both sides of the yarn splicing member 101 are clamped by the clamping devices 108 and 109, respectively, the yarn handling lever 105 is rendered operative and the rod 31*a* shown in FIG. 5 is moved in a direction of an arrow mark 31*b* by means of a control cam not shown to pivot the lever 32 in the clockwise direction around the support shaft 31. In this condition, a cutting operation is carried out. It is to be noted that when the handling lever 105 and the cutting devices 106 and 107 are operated, the yarn pressing device 102 is ready for operation at a position 102*a* as indicated in two dots and dash lines in FIG. 5.

(c) Yarn End Untwisting Step

Figure 22:
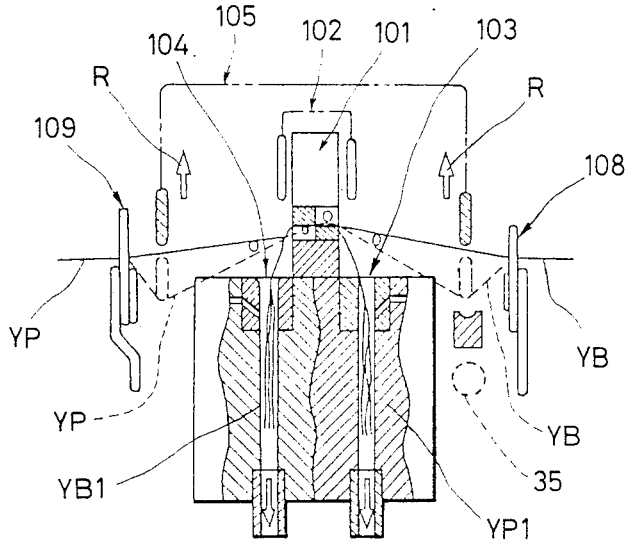

Subsequently, as shown in FIG. 22, the yarn end sections YP1 and YB1 are sucked by and into the yarn end untwisting nozzles 103 and 104, respectively, and at the same time with or just before or after this sucking action, the yarn handling lever 105 is moved in a direction R away from the yarns so that the yarn end sections YP1 and YB1 are allowed to be sucked deeply into untwisting nozzles in which the twist thereof is untwisted into a condition adapted for splicing of yarns by means of injecting of fluid, as described hereinabove.

Preferably, the sucking operation of the untwisting nozzles 103 and 104 is initiated just before yarns are cut by the cutting devices 106 and 107, respectively. This is because, since a tensile force is applied to a yarn Y due to a sucking action of the suction mouth and the relay pipe when the yarn Y is cut, the yarn end sections YP1 and YB1 which are let free by cutting thereof will sometimes be scattered and thus moved away from the openings of the untwisting nozzles 103 and 104, resulting in an error in suction of yarn end sections by the untwisting nozzles. It is to be noted that supply of fluid to the untwisting nozzles may be effected by changing over of a valve by means of a solenoid not shown.

(d) Yarn Splicing Step

Figure 23:
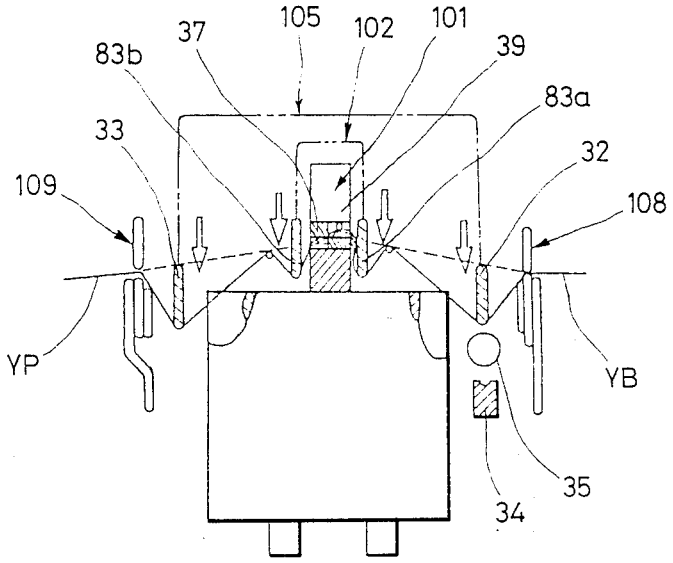

After the twist of the yarn end sections YP1 and YB1 have been untwisted into a condition suitable for splicing of yarns by means of the yarn end untwisting nozzles 103 and 104, respectively, the sucking actions of the untwisting nozzles 103 and 104, the flexible pipe 87, and the fluid injecting hole 63 are all stopped. At the same time with or just before or after such stopping, the yarn handling lever 105 is rendered operative again to guide the yarn end sections YP1 and YB1 to draw them out of the untwisting nozzles 103 and 104 and place the thus untwisted yarn end sections one on the other at a predetermined position on the yarn splicing member, as shown in FIG. 23. In this case, one 32 of the arms of the yarn handling lever 105 is pivoted to a position in which it is abutted against the stop 35, and the yarn pressing device 102 is operated to pivot to a position as shown in FIGS. 23 and 20 in which yarn holding plates 83*a* and 83*b* thereof cooperate with the guide rods 28*a* and 28*b*, respectively, to provide curved configurations to portions of the yarns YP and YB between the yarn splicing chamber 54 and the clamping devices 108 and 109 or more specifically between the yarn splicing chamber 54 and the yarn handling arms 32 and 33.

The yarn end sections YP1 and YB1 inserted in the nozzle holes of the untwisting nozzles 103 and 104 by means of the yarn handling lever 105 and the yarn pressing device 102 are then drawn toward within the yarn splicing chamber 54 of the yarn splicing member 101 and are thus positioned in mutually contacted conditions by cooperation of the control plates 25 and 26 and the yarn pressing device 102 as shown in FIGS. 9 and 10.

Then, after completion of positioning of the yarn end sections, in accordance with a principle as described hereinafter, splicing of the yarns is effected by a whirling flow of compressed fluid which is injected from the fluid injecting holes 58 and 59 of FIG. 10.

Figure 24:
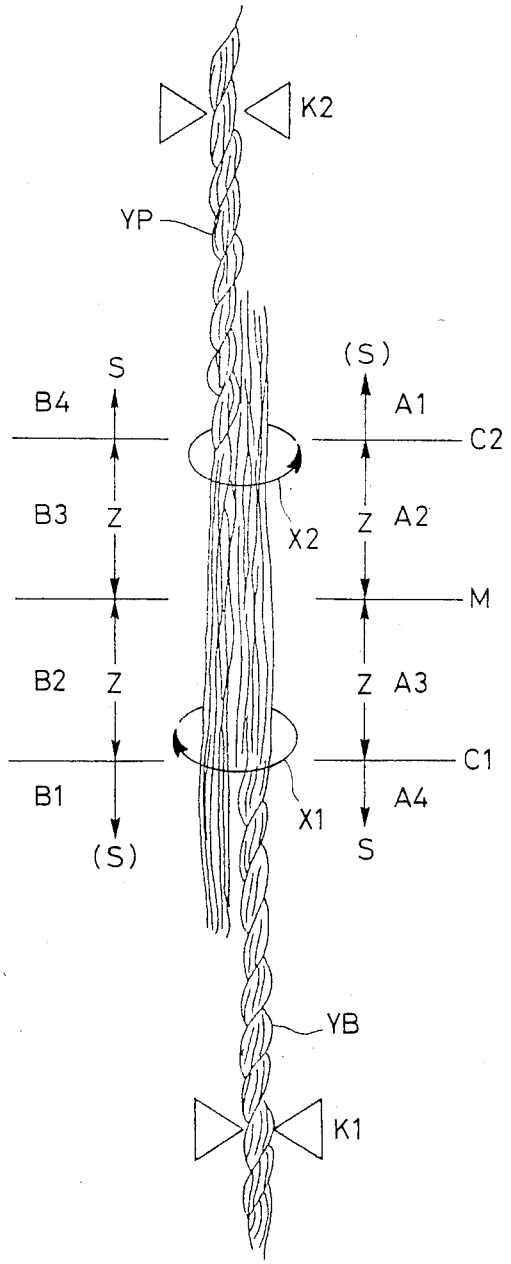
FIG. 24 is a diagrammatic representation illustrating the principle of a yarn splicing operation of a yarn splicing nozzle unit according to the present invention.

In particular, referring to FIG. 24, one yarn is cut to provide two separate yarn ends YP and YB. The yarn ends YP, YB are directed in opposite directions to each other and are overlapped one on the other in a parallel or crossing relationship to each other. Extremity portions of both yarn ends are untwisted for preparation of splicing of the yarns. The untwisted portions are portions at which twists peculiar to the yarn are either substantially zero or rather smaller in number than the number of twists peculiar to the yarn, and preferably the yarn ends are reduced to no twist conditions in which fibers constituting each yarn run substantially in parallel relationship to each other.

Further, the extremity portions of the ends of the yarns YP, YB are not constrained and thus remain in free conditions while each yarn YP, YB is clamped at a point thereof which is spaced a predetermined fixed distance from the extremity thereof so that it may not be untwisted beyond the clamped point K1 or K2 thereof, which thus provides a fixed point.

In this condition, both yarns YP, YB are turned in opposite directions X1 and X2 at two different points C1 and C2 of the overlapping area thereof. In particular, the turning directions are determined in association with twisting directions peculiar to the yarns to be spliced to each other, and the turning direction at the position C2 is selected to be the direction X2 in which the peculiar twist of portions of the yarns between the clamped point K2 of the yarn YP and the twisting point C2 due to turning of the yarns is released or untwisted while the turning direction at the position C1 is selected to be the direction X1 at which the peculiar twist of portions of the yarns between the other clamped point K1 of the yarn YB and the twisting point C1 is released or untwisted. The yarns YP and YB shown are represented to have peculiar twists in a Z direction, but it is obvious that, where a yarn has an S twist, the turning directions X1, X2 are reversed.

It is to be noted that a turning flow of a fluid provided by injection thereof is employed for means for turning yarns and especially an air flow may be employed which is most available among others.

Now, behavior of yarns caused by such a turning action as described above will be described.

Here, for facilitation of description, a segment of the yarn YB between the clamped point K1 and the extremity of the end thereof is divided into four sections A1 to A4.

In particular, the section A1 is a section between the extremity of the yarn end and the turning flow applying point C2;

the section A2 is a section from the turning flow applying point C2 to the center M between the turning providing points C1, C2;

the section A3 is a section from the center M to the turning providing point C1; and the section A4 is a section from the turning providing point C1 to the other clamped point K1. Similarly, the other yarn YP is divided into sections B1 to B4 from the extremity of the yarn end.

The sections A1, A2 of the yarn YB and the sections B3, B4 of the yarn YP are turned in the same direction as that indicated by the arrow mark X2 by a turning flow at the turning providing point C2 in the direction of the arrow mark X2.

In this case, an S twisting force is applied to portions of the yarns in the sections A1 and B4 while a Z twisting force is applied to portions of the yarns in the sections A2 and B3. But, since the yarn YB in the section A1 is in a free or open-ended condition, the S twist disappears from the yarn section A1 while the actual Z twist remains in the yarn YB in the section A2. At the same time, fibers untwisted from the yarns in the sections A2 and A3 are interlaced and united with each other and are twisted in the Z twist while the end portion of the yarn in the section A1 is interlaced in the Z direction with a portion of the yarn YP in the section B4 and is thus twisted progressively. If a portion of the yarn YP in the section B4 is in an untwisted condition, then fibers in the sections A1 and A4 are also interlaced and united with one another, thereby forming a single yarn of the Z twist.

It is to be noted, however, that since the portion of the yarn YP in the section B4 is turned in the direction to release the twist peculiar to the yarn, it tends to be untwisted thereby, but if the yarn portions in the sections B3 and B4 are held to the utmost from being turned, then the portions of the yarn YB in the A1 and A2 sections will be turned principally around the other yarn YP. As a result, the yarn YB is wound or twisted in the Z direction around the yarn YP while it is further twisted into the Z twist around itself.

Further, turning of the yarns in the direction of the arrow mark X1 at the other turning providing point C1 will also cause similar phenomena to those as described above. In this case, the end portion of the yarn YP in the section B1 is in a free condition, and hence, while the Z twist is also provided to the portion of the yarn YP in the section B2, fibers of the yarn YP in the sections B1, B2 will be interlaced and united with fibers of the yarn YB, thereby forming a single yarn which is twisted in the Z direction.

Accordingly, the end portions A1, A2 of the yarn YB positioned adjacent the turning providing point C2 relative to the center or mid point M between the turning providing points C1 and C2 are progressively twisted in the Z direction, that is, in the same direction as the peculiar twisting direction of the yarn and are wound around the portions of the yarn YP in the sections B4 and B3 while the end portions of the yarn YP in the sections B1 and B2 positioned on the C1 side relative to the mid point M are twisted in the Z direction, that is, in the same direction as the peculiar twisting direction of the yarn and are wound around the portions of the yarn YB in the sections A4 and A3. As a result, the twist in the same direction as the original twisting direction of the yarns is provided over the entire area of the spliced joint thus formed, and depending upon untwisted conditions of overlapping portions of yarn ends before splicing thereof, the joint after splicing of the yarns will come to have a similar structure to that of the parent yarn.

Figure 25:
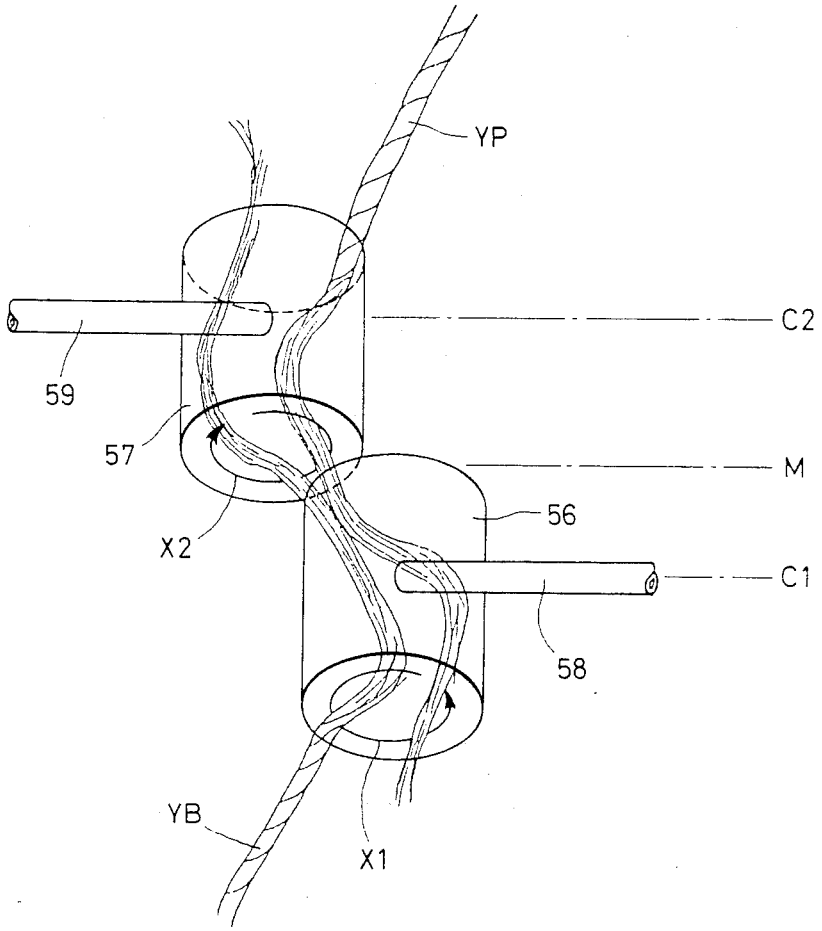
FIG. 25 is a diagrammatic representation illustrating relative positions of divided yarn splicing nozzle holes and behavior of yarns during a yarn splicing operation.

FIG. 25 diagrammatically shows a yarn splicing chamber of a yarn splicing device according to the present invention with its slit 55 omitted therefrom. In this figure, behavior of yarns within the yarn splicing holes 56 and 57 of the yarn splicing nozzle unit U1 shown in FIGS. 11 and 12 is diagrammatically illustrated so as to further facilitate understanding particularly of relationships of the yarn splicing holes 56 and 57.

Figure 26:
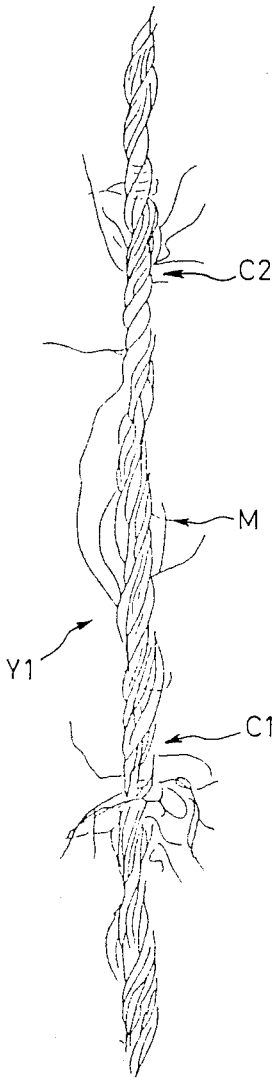
FIG. 26 is a diagrammatic representation illustrating an example of a spliced joint obtained by the yarn splicing device.

Examples of joints formed by such splicing are illustrated in FIG. 26. FIG. 26 is an illustrative view of a spliced joint wherein yarn ends are untwisted over an entire area of overlapping portions thereof. From this figure, it can be seen that the spliced joint Y1 is in the form of a single yarn having an actual twist (Z twist) in the same direction over the entire area thereof such that the original two yarns cannot be distinguished from each other with fibers of the yarn ends interlaced with one another to unite the both yarns into a single twisted yarn. In this case, a spliced joint of a high quality can be obtained wherein characteristics of yarns thereat are not a bit inferior to those of a parent single yarn. Besides, a joint has no antenna extending from an end of each of yarns thus spliced.

Results of measurements of spliced joints obtained in this way with parent or original yarns regarding the strength and stretch are shown below. As a yarn splicing device, the yarn splicing device as shown in FIG. 2 was applied to the winder as shown in FIG. 1, and as a yarn splicing unit, the unit and the yarn splicing member as shown in FIGS. 10, 11 and 12 were used. The pressure of air from the fluid injection nozzle hole was 6.0 kg/cm$^2$ while the pressure of air injected into the untwisting nozzles 103, 104 in which yarns were inserted with their ends untwisted was 6.5 kg/cm$^2$.

Example 1. (Table 1)

The parent yarn was a card yarn of cotton Ne10.

TABLE 1

| Sample (number) | Parent Yarn Strength 30 | Parent Yarn Stretch 30 | Spliced Joint Strength 30 | Spliced Joint Stretch 30 |
|---|---|---|---|---|
| Maximum | 1,026 (g) | 46 (mm) | 852 (g) | 40 (mm) |
| Minimum | 736 | 35 | 528 | 28 |
| Average | 884 | 40 | 739 | 35 |
| Coefficient of variation (%) | 9.6 | 6.3 | 9.7 | 8.9 |
| Coefficient of retention (%) | 100 | 100 | 83.5 | 85.7 |

Example 2. (Table 2)

The parent yarn was comber yarn of cotton Ne40.

TABLE 2

| Sample (number) | Parent Yarn Strength 30 | Parent Yarn Stretch 30 | Spliced Joint Strength 30 | Spliced Joint Stretch 30 |
|---|---|---|---|---|
| Maximum | 268 | 28 | 263 | 28 |
| Minimum | 211 | 22 | 200 | 22 |
| Average | 237 | 25 | 233 | 25 |
| Coefficient of variation (%) | 7.2 | 5.5 | 6.3 | 5.9 |
| Coefficient of retention (%) | 100 | 100 | 98.2 | 99.6 |

Example 3. (Table 3)

The parent yarn was a yarn of cotton Ne120.

TABLE 3

| Sample (number) | Parent Yarn Strength 30 | Parent Yarn Stretch 30 | Spliced Joint Strength 30 | Spliced Joint Stretch 30 |
|---|---|---|---|---|
| Maximum | 136 | 32 | 115 | 29 |
| Minimum | 84 | 22 | 80 | 20 |
| Average | 105 | 27 | 100 | 26 |
| Coefficient of variation (%) | 11.8 | 7.9 | 9.6 | 7.9 |
| Coefficient of retention (%) | 100 | 100 | 96.0 | 95.6 |

Example 4. (Table 4)

The parent yarn was a yarn of ester 100% Ne40.

TABLE 4

| Sample (number) | Parent Yarn Strength 30 | Parent Yarn Stretch 30 | Spliced Joint Strength 30 | Spliced Joint Stretch 30 |
|---|---|---|---|---|
| Maximum | 562 | 70 | 556 | 64 |
| Minimum | 338 | 46 | 352 | 40 |
| Average | 479 | 59 | 466 | 55 |
| Coefficient of variation (%) | 11.9 | 10.5 | 11.0 | 11.4 |
| Coefficient of retention (%) | 100 | 100 | 97.4 | 92.9 |

Example 5. (Table 5)

The parent yarn was a yarn of cotton Ne80/2 having a second twist in the Z direction.

TABLE 5

| Sample (number) | Parent Yarn Strength 30 | Parent Yarn Stretch 30 | Spliced Joint Strength 30 | Spliced Joint Stretch 30 |
|---|---|---|---|---|
| Maximum | 266 | 48 | 259 | 42 |
| Minimum | 163 | 20 | 151 | 23 |
| Average | 214 | 34 | 213 | 32 |
| Coefficient of variation (%) | 12.9 | 16.5 | 14.4 | 15.6 |
| Coefficient of retention (%) | 100 | 100 | 99.6 | 92.8 |

Example 6. (Table 6)

The parent yarn was an acryl/cotton union yarn of Ne30.

TABLE 6

| Sample (number) | Parent Yarn Strength 30 | Parent Yarn Stretch 30 | Spliced Joint Strength 30 | Spliced Joint Stretch 30 |
|---|---|---|---|---|
| Maximum | 200 | 35 | 194 | 34 |
| Minimum | 126 | 20 | 124 | 17 |
| Average | 163 | 27 | 157 | 26 |
| Coefficient of variation (%) | 9.2 | 11.9 | 11.9 | 16.2 |
| Coefficient of retention (%) | 100 | 100 | 96.9 | 96.6 |

It is to be noted that the stretch above is represented by an amount of stretch on a tension tester using a yarn of 500 mm in length as a sample yarn.

From the results of the experiments, according to the yarn splicing device of the present invention, spliced joints obtained with various yarns which are different in type and yarn count have high maintenance ratios of 85%–99% of the strength and stretch relative to parent yarns, and thus very good spliced joints can be obtained which have characteristics very similar to those of parent or original yarns.

As apparent from the foregoing description, according to the present invention, a yarn splicing chamber in which ends of yarns are inserted in an oppositely directed and overlapped relationship and are acted upon by fluid to splice the yarns to each other is substantially divided into two sections, and thus divided two yarn splicing holes are formed to have their axes displaced from each other. As a result, flows of fluid injected do not interfere with each other within the yarn splicing holes, and hence such whirling flows act very effectively. Accordingly, high quality spliced joints can be obtained which are very similar in the strength, stretch, and so on, to parent yarns.

What is claimed is

1. A yarn splicing device wherein extremities of ends of two yarns which are inserted in overlapping and oppositely directed relationship in a yarn splicing chamber are acted upon by a whirling fluid flow to splice the two yarns to each other, characterized in that said yarn splicing chamber is substantially divided in an axial direction thereof into two yarn splicing holes which have center axes displaced from each other.

2. A yarn splicing device as claimed in claim 1, wherein each of said yarn splicing holes has a fluid injecting nozzle hole perforated to open in tangential relationship to an inner circumferential face of the yarn splicing hole.

3. A yarn splicing device as claimed in claim 1, wherein said yarn splicing chamber is formed in a yarn splicing nozzle unit which is removably fitted in a yarn splicing member of the yarn splicing device.

4. A yarn splicing device as claimed in claim 3, wherein said yarn splicing nozzle unit has first and second yarn splicing holes formed therein which each present a substantially circular cross section in a plane perpendicular to an axis thereof, and a yarn inserting slit formed therein in common relationship to both yarn splicing holes, a side wall of said slit being tangentially continuous to an inner circumferential face of the first yarn splicing hole while another side wall of said slit being tangentially continuous to an inner circumferential face of the second yarn splicing hole.

5. A yarn splicing device as claimed in claim 4, wherein fluid injecting nozzle holes are tangentially opened to said inner circumferential faces of the first and second yarn splicing holes, respectively, and are perforated adjacent portions at which the slit and the inner circumferential faces cross each other so that fluid injected from the nozzle holes may form whirling flows in opposite directions to each other.

6. A yarn splicing device as claimed in chaim 4, wherein fluid injecting nozzle holes are tangentially opened to said inner circumferential faces of the first and second yarn splicing holes, respectively, and are formed at portions of the unit opposite to the slit.

7. A yarn splicing device as claimed in claim 6, wherein said fluid injecting nozzle holes extend in parallel relationship to each other.

8. A yarn splicing device as claimed in claim 1, wherein bottom faces of said yarn splicing holes are contained in a same plane so as to prevent interference of whirling fluid flows in the individual yarn splicing holes with each other.

9. A yarn splicing device as claimed in claim 1, wherein bottom faces of said yarn splicing holes, respectively, are inclined toward their respective counterparts and the incline bottom faces are formed to be parallel each other with some distance therebetween so that the whirling fluid flow in the yarn splicing hole flows along the inclined bottom face into the other yarn splicing hole.

* * * * *